US006057823A

United States Patent [19]

Aoki et al.

[11] Patent Number: 6,057,823

[45] Date of Patent: May 2, 2000

[54] TIMING SIGNAL GENERATING CIRCUIT

[75] Inventors: Yoshiro Aoki; Masaki Miyatake, both of Yokohama, Japan

[73] Assignee: Kabushiki Kaisha Toshiba, Kanagawa-Ken, Japan

[21] Appl. No.: 08/840,855

[22] Filed: Apr. 17, 1997

[30] Foreign Application Priority Data

Apr. 17, 1996 [JP] Japan ..... 8-095566

[51] Int. Cl.[7] ..... G09G 3/36

[52] U.S. Cl. ..... 345/99; 345/100; 345/93; 349/54; 326/11

[58] Field of Search ..... 345/99, 98, 93, 345/214, 100; 326/9–13, 35; 349/54; 714/797; 327/292

[56] References Cited

U.S. PATENT DOCUMENTS 5,140,594 8/1992 Haulin ..... 714/797
5,537,583 7/1996 Truong ..... 713/500
5,559,459 9/1996 Back et al. ..... 326/93
5,680,408 10/1997 Tsirkel ..... 714/797
5,784,386 7/1998 Norris ..... 714/797
5,859,627 1/1999 Hoshiya et al. ..... 345/100

*Primary Examiner*—Dennis-Doon Chow
*Assistant Examiner*—Amr Awad
*Attorney, Agent, or Firm*—Pillsbury Madison & Sutro LLP

[57] ABSTRACT

A timing signal generating circuit has a plurality of timing signal generating units disposed in series, each including three or more pieces of timing signal generating elements connected in parallel, and a connecting unit disposed in between the plurality of timing signal generating units. The connecting unit includes an arithmetic circuit which outputs relatively majority signal among outputs of the timing signal generating elements.

In this circuit, if some of the timing signal generating elements output defective signals, normal signal is picked-up and output through majority operation of the arithmetic circuit without repairing.

2 Claims, 17 Drawing Sheets

TIMING SIGNAL GENERATING CIRCUIT

BACKGROUND OF THE INVENTION

The present invention relates generally to a timing signal generating circuit and is preferably applicable, more particularly, to a driving circuit of a video display apparatus using a matrix drive system.

The following is a description of construction of a video display apparatus employing a matrix driving system, especially an active matrix type liquid crystal display device.

FIG. 16 is a schematic diagram illustrating a typical construction of the active matrix type liquid crystal display apparatus.

A liquid crystal display element 1201 which is an element for displaying picture images is disposed at each intersection between a signal line 1203 serving as an X-line and a gate line 1204 serving as a Y-line, and is connected to the X-line 1203 and the Y-line 1204. The X- and Y-lines 1203, 1204 are connected respectively to an X-line drive circuit 1206 and Y-line drive circuit 1207, and a timing at which timing signal generating circuits 1208, 1209 respectively constituting the drive circuits 1206, 1207 transmit electric signals, is thereby controlled.

FIG. 17 is a circuit block diagram showing one example of a shift register type timing signal generating circuit.

In this timing signal generating circuit, flip-flop circuits 1303 each consisting of an inverter 1302 and two pieces of loop-connected inverters 1301 each serve as one constructive unit of the shift register and are serially connected. Then, a timing input signal to the shift register is shifted stage by stage for every clock of each stage, thereby generating a timing output signal for controlling the timing of the X- and Y-lines 1203, 1204.

Note that symbols $\phi$ and $/\phi$ in the Figure represent clock signals, and the clocks $\phi$ and $/\phi$ are in a mutually inverted relationship (which is the same hereinbelow).

The video display element may involve the use of, in addition to the liquid crystal display element, discharge gases, fluorescent materials, light emitting diodes, light source tubes, electron beam fluorescent tubes, and magneto-electric driving type reflection display elements. In any display element, a display state is varied by the electric signals supplied to the X- and Y-lines corresponding to the timings, an arbitrary picture is thereby displayed on the screen.

As described above, the matrix drive system video display apparatus is capable of arbitrarily changing the display state on the screen by controlling the timings of transmitting the electric signals to the X- and Y-lines.

If this drive timing becomes defective, however, the display elements arrayed in matrix become uncontrollable, resulting in a linear or planar defective display on the screen. For example, in a shift register type timing control circuit, when the timing input signal to be transmitted to a next-stage shift register becomes defective, the display elements controlled by the shift registers subsequent thereto are all brought into a display defective state.

Further, the shift register type timing control circuit is constructed such that the supplied-from-outside signals such as the clock signals, the timing input signals (start pulses), etc. are connected directly to the respective elements within the circuit, and therefore extremely fragile against an electrostatic breakdown during a manufacturing process. In particular, this defect in terms of construction is the problem inherent in a drive circuit integral type video display apparatus in which a drive circuit is formed simultaneously with the display element, and this problem turns out an obstacle against enhancing a yield and a reliability of the video display apparatus as well as against decreasing costs for the display apparatus.

A first countermeasure to obviate the above problem entails an adoption of such a construction that the X- and Y-lines are respectively driven on both sides of the lines, and, if the drive circuit on one side falls into a breakdown, the drive circuit on the other side compensates it.

Proposed further as a second countermeasure is a construction wherein a decoder system for generating the timing output signals selectively corresponding to input coded numerical signals are applied to the timing signal generating circuit.

FIG. 18 is a circuit block diagram showing one example of the decoder type timing signal generating circuit. Unlike the sift register system in which the timing input signals are shifted stage by stage for every clock of each stage, each decoder circuit 1401 generates the timing output signal, and therefore the planar display defect as seen in the shift register type circuit hardly occur. Besides, there must be an advantage in which an operation of cutting off the defective line and repairing it can be more simplified than by the shift register type circuit.

Proposed also as a third countermeasure is such a construction that a preparatory shift register or decoder is previously included in the drive circuit.

FIG. 19 is a circuit block diagram showing a timing signal generating circuit including the preparatory shift register. FIG. 20 is a circuit block diagram illustrating a timing signal generating circuit including the preparatory decoder. Based on these constructions, if drive defects are caused on the shift register and the decoder, a shift register 1502 or a decoder 1505 troubled with the drive defect is disconnected from the line by a laser or the like. Then, a preparatory shift register 1501 or a preparatory decoder 1504 included therein is connected to a preparatory shift register connecting node 1503 or a preparatory decoder connecting node 1504 by use of a conductive material such as silver paste, etc., or by irradiation of laser beams.

A fourth countermeasure proposed may be a construction wherein k-trains (k is two or more) of shift registers operating at the same timing are disposed in parallel, and k-input NOR circuits are inserted between two stages (FIG. 21).

FIG. 21 is a circuit block diagram of a timing signal generating circuit constructed such that the k-trains of shift registers operating at the same timing are, as shown in FIG. 2, P.40, Vol.56 of the Sharp Corporation Technical Report, arranged in parallel, and the k-input NOR circuits are inserted at the interval of the plurality of stages of the shift registers. According to this construction, even if some of k-trains of shift registers 1601 fall into breakdown, a NOR circuit 1602 is capable of picking up and eliminating the defective timing input signal. Besides, even if incapable of picking up and eliminating the defective signal, a normal drive operation can be done by disconnecting the k-input NOR circuit from the shift register train with the defect occurred therein.

The following are problems inherent in the respective constructions of countermeasures given above.

According to the first countermeasure, i.e., the construction of respectively driving the X- and Y-lines on both sides of the lines and, if the drive circuit on one side falls into the breakdown, compensating it by the drive circuit on opposite side, this construction can not be adopted in principle when the lines are to be driven on both sides on account of a magnitude of the drive load. Further, even if the drive load is small enough to be drive on one side, there arises a necessity for electrically disconnecting the defective drive circuit from the matrix line, and hence there must be performed an operation of cutting off a part of the line by use of the laser, etc.

The second countermeasure, i.e., the decoder type timing signal generating circuit is based on the premise that the lines can be driven on one side, and the condition remains the same as requiring the operation of cutting off the defective portion by the laser.

The third counter measure, i.e., the construction of incorporating the preparatory shift register or decoder into the drive circuit, might need the operations of cutting off the defective portion by the laser and of connecting the preparatory circuit. Therefore, this counter measure is, it can not be said, realistic in terms of mass production because of the drive circuit repair process being complicated.

According to the fourth countermeasure, i.e., the construction of arranging in parallel the k-trains, over two trains, of shift registers operating at the same timing and inserting the k-input NOR circuits at the interval of the plurality of stages, if some defect happens in the shift register, and a judgement as to whether the defect is gets fixed on a High-side or a Low-side is different as the case may be. The defect getting fixed on the High-side might require the operation of disconnecting the line by use of the laser, etc.

Moreover, a problem pertaining to the above-described constructions as a whole may be concerned with a reliability of the drive circuit. If the timing signal generating circuit becomes defective during the use of the video display apparatus, the video display apparatus can not be continuously used without performing the repairing operation in the prior arts. Accordingly, especially in the drive circuit integral type video display apparatus, it is much importance in terms of enhancing the reliability of the display apparatus to construct the whole drive circuit in consideration of the reliability of each of the elements constituting the drive circuit.

SUMMARY OF THE INVENTION

It is therefore an object of the present invention, which was contrived in view of the problems given above, to provide a timing signal generating circuit capable of being continuously used without performing a repairing operation even if a defect occurs in some of elements constituting the circuit, and, as a result, to attain enhancements of a yield and a reliability of the timing signal generating circuit itself or a drive circuit or a video display apparatus as a whole.

According to a first aspect of the present invention, there is provided a timing signal generating circuit having:

a plurality of timing signal generating units, each including three or more pieces of timing signal generating means each generating a binary timing signal, said timing signal generating means being connected in parallel, said timing signal generating units being disposed in series; and a connecting unit, disposed in between said plurality of timing signal generating units disposed in series, for generating a predetermined timing signal on the basis of an output said each timing signal generating means of said timing signal generating unit at a stage anterior thereto and outputting the predetermined timing signal to said timing signal generating unit at a stage posterior thereto, wherein said connecting unit includes a first arithmetic means for picking up signals outputted by relatively majority of said timing signal generating means among outputs of said respective timing signal generating means belonging to said timing signal generating unit at the anterior stage, and outputting the picked-up signals to said timing signal generating unit at the posterior stage.

In this circuit, if some of the timing signal generating elements output defective signals, normal signal is picked-up and output through majority operation of the arithmetic circuit without repairing.

According to a second aspect of the present invention, there is provided a display apparatus having:

a timing signal generating circuit including:

a plurality of timing signal generating units, each including three or more pieces of timing signal generating means each generating a binary timing signal, said timing signal generating means being connected in parallel, said timing signal generating units being disposed in series; and a connecting unit, disposed in between said plurality of timing signal generating units disposed in series, for generating a predetermined timing signal on the basis of an output said each timing signal generating means of said timing signal generating unit at a stage anterior thereto and outputting the predetermined timing signal to said timing signal generating unit at a stage posterior thereto, said connecting unit including an arithmetic means for picking up signals outputted by said relatively majority of timing signal generating means among the outputs of said timing signal generating means belonging to said anterior-stage timing signal generating unit, and outputting the picked-up signals to said posterior-stage timing signal generating unit and output terminals in parallel therewith;

a driving unit for sampling a predetermined drive signal based on the output of the output terminal of said timing signal generating circuit and outputting the drive signal to a drive line; and a plurality of unit pixels connected to the drive line.

DESCRIPTION OF THE PREFERRED EMBODIMENTS

Embodiments of a timing signal generating circuit according to the present invention will hereinafter be described in detail with reference to the accompanying drawings.

Figure 1:
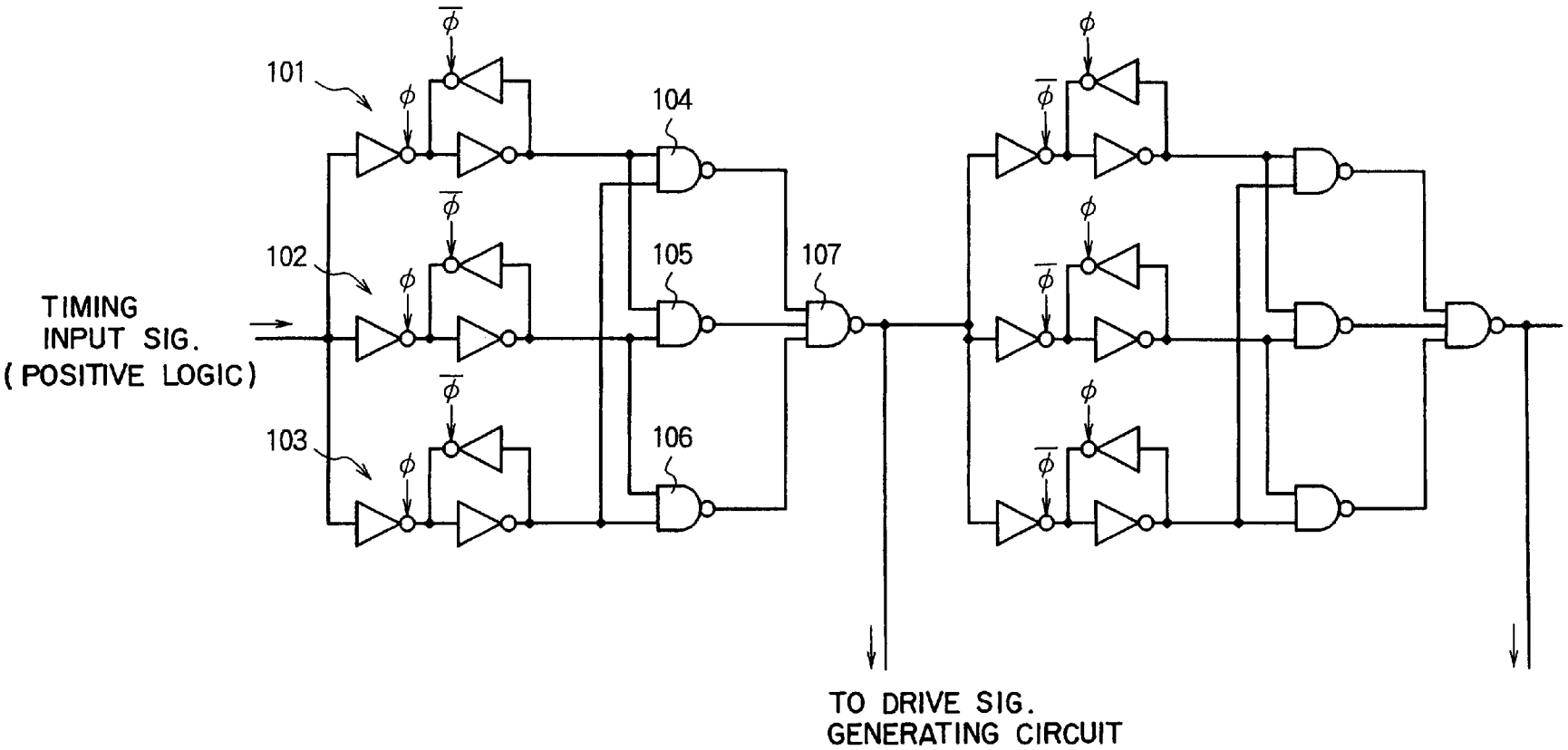
FIG. 1 is a circuit block diagram illustrating a timing signal generating circuit in a first embodiment of the present invention.

FIG. 1 is a circuit block diagram illustrating a timing signal generating circuit in accordance with a first embodiment of the present invention.

One unit of the timing signal generating circuit in the first embodiment comprises a shift register train consisting of three pieces of shift registers 101, 102, 103 which simultaneously perform the same operation upon receiving the same clock signals and the same positive logic timing input signals, three pieces of 2-input NAND circuits 104, 105, 106, disposed on an output side of the shift register train, to which mutually different combinations each consisting of two outputs of respective outputs of the three shift registers 101, 102, 103 are each supplied, and a single piece of 3-input NAND circuit 107 to which respective outputs of the three 2-input NAND circuits 104, 105, 106 are supplied.

Each of the shift registers 101, 102, 103 is constructed of an inverter and a flip-flop circuit, and an arrangement that the timing input signal is shifted stage by stage per clock of each stage is the same as the prior art. These shift registers behave as a timing signal generating unit.

An output of the 3-input NAND circuit 107 becomes an output of the next stage as well as a timing output signal at its output terminal. In the case of a video display apparatus, this timing output signal is supplied to a drive signal generating circuit, and matrix lines of a display unit are driven. These four NAND circuits composes a connection unit.

Thus, the one unit of the timing signal generating circuit is composed of a timing signal generating unit and a connection unit, and these constructive units are serially connected at a plurality of stages.

When the construction of the first embodiment is employed, even if any one of the three shift registers 101, 102, 103 goes defective to output an abnormal signal, an arithmetic circuit constructed of the three 2-input NAND circuits 104, 105, 106 and the 3-input NAND circuit 107 picks up a relatively majority signal and as a result eliminates the defective signal. Then, the signals are normally outputted to the shift register train of the next stage, and the timing output signals are kept in a normal status. Further, irrespective of how the defective signal may be on that occasion, it is feasible to output the signals to the next-stage shift register train and keep the timing output signals in the normal status even when there might be an open state between the shift register and the arithmetic circuit due to a defect in wiring. Moreover, even if the two shift registers simultaneously fall into breakdown, and when one shift register is defective enough to continuously output a High signal while the other is defective to continuously output Low signal, the normal operation can be kept.

As discussed above, in the first embodiment of the present invention, since the train of three shift registers with the arithmetic circuit are employed and the arithmetic circuit picks up relatively majority true signal, the timing signal generating circuit can be continuously used without any repairing operation even when a defective signal of some shift registers is generated. As a result, a yield and a reliability of the drive circuit or the video display apparatus as a whole can be enhanced.

Figure 2A:
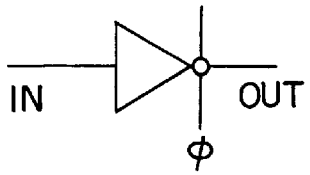
FIG. 2A shows an equivalent circuit symbol of a clocked inverter as a first example of a logical circuit included in a shift register.
Figure 2B:
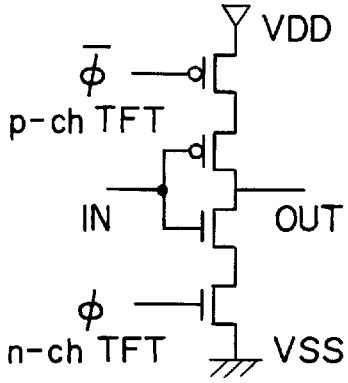
FIG. 2B is a practical CMOS circuit diagram of the clocked inverter shown in FIG. 2A.
Figure 3A:
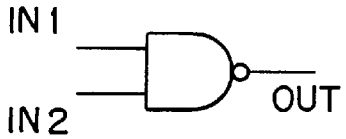
FIG. 3A shows an equivalent circuit symbol of a NAND gate as a second example of the logical circuit included in the shift register.
Figure 3B:
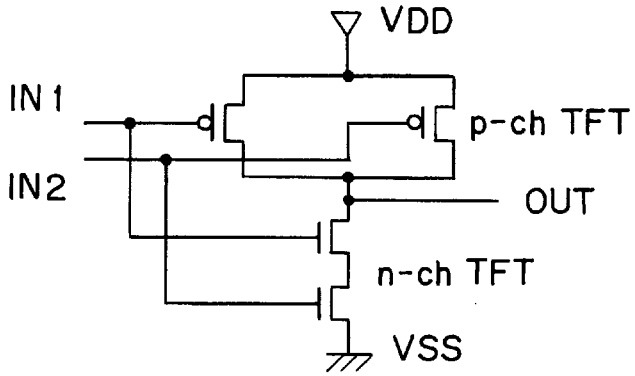
FIG. 3B is a circuit diagram of the NAND gate shown in FIG. 3A.
Figure 4A:
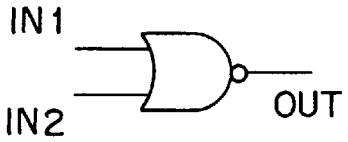
FIG. 4A shows an equivalent circuit symbol of a NOR gate as a third example of the logical circuit included in the shift register.
Figure 4B:
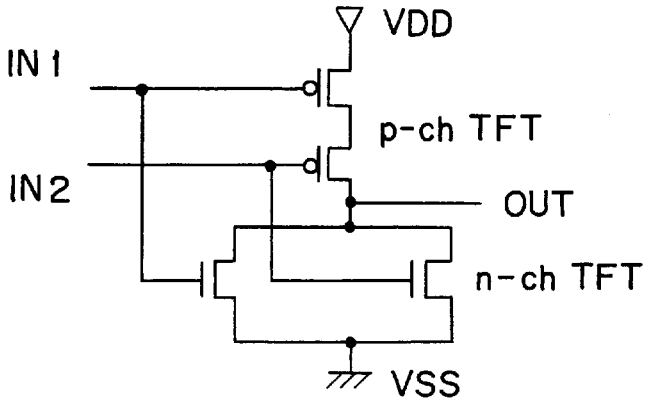
FIG. 4B is a circuit diagram of the NOR gate shown in FIG. 4A.

FIGS. 2A, 3A and 4A show equivalent logical circuit components composing the shift registers. FIGS. 2B, 3B and 4B show their practical circuit diagrams. As shown these diagrams, FIG. 2A illustrates a clocked inverter, FIG. 3A illustrates a two-input NAND circuit and FIG. 4A illustrates a two-input NOR circuit. These circuits are constructed by combining and arranging well-known CMOS circuits.

Figure 5:
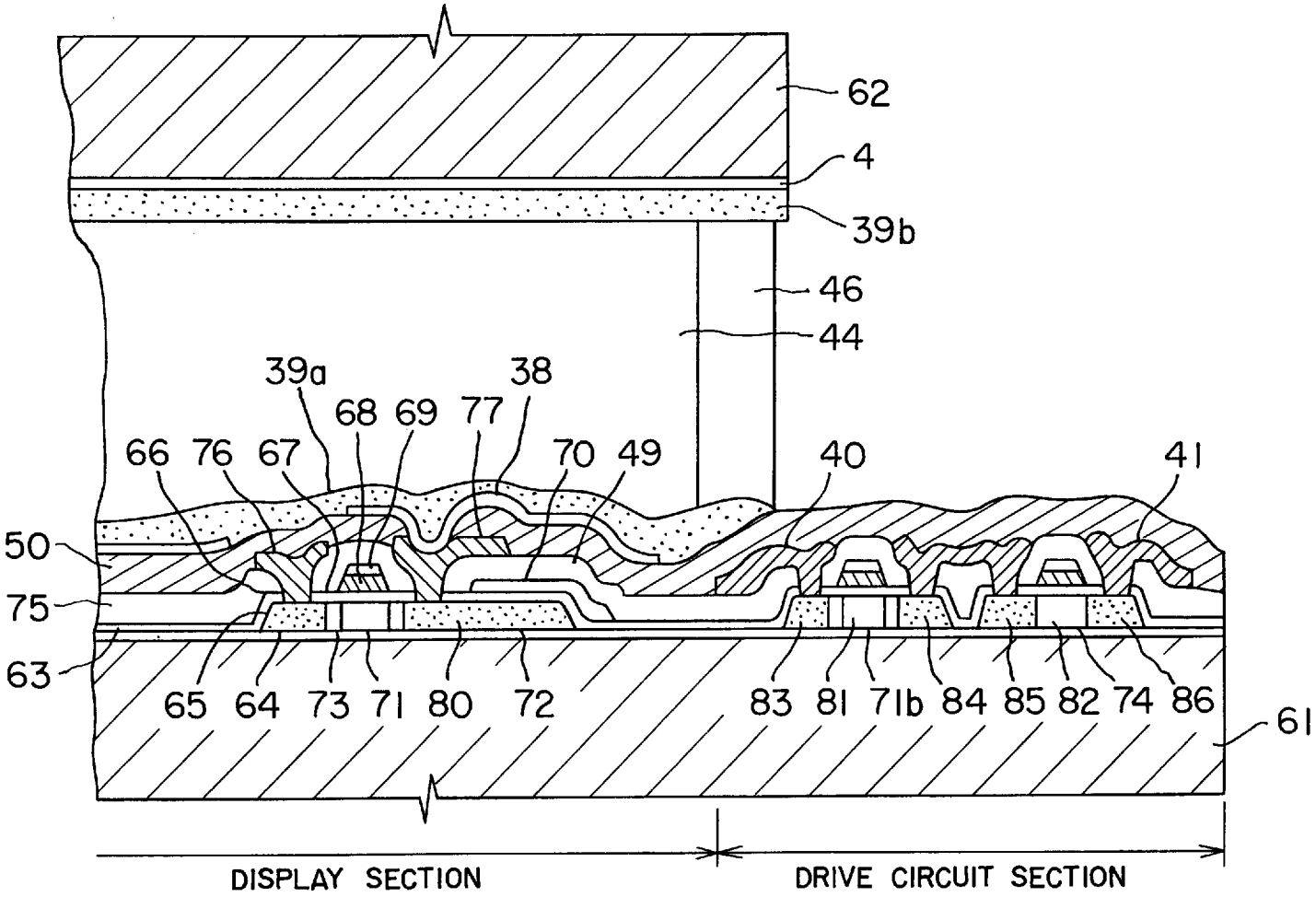
FIG. 5 is a sectional view showing a structure of main part of a liquid crystal display panel having a drive circuit therein.

FIG. 5 shows a cross sectional view of a principal part of a liquid crystal panel having a driving circuit including the above-mentioned logical circuits and a display section.

A Thin Film Transistor (TFT) 71 disposed in the display section is an n-channel type TFT, and a source electrode 77 thereof is connected to a pixel electrode 38 which is composed of a transparent electrode. Furthermore, a gate electrode thereof is connected to a gate line (not shown) and a drain line 76 is connected to a signal line (not shown).

The driving circuit is composed of an n-channel type TFT 71*b* and p-channel type TFT 74. These transistors are formed simultaneously with the TFT 71 formed in the display section. That is, after forming an amorphous silicon film on the substrate 61, polycrystallization is performed by irradiating a laser light. Then by patterning the polysilicon film into the predetermined shape, polysilicon layers 80, 81 and 82 are obtained. On these layers, after an insulating film 67 is formed, a gate electrode 68 is selectively formed. Then impurity ions are doped into the polysilicon layers 80, 81 and 82 and impurity ions are driven in the source region 72, 84 and 86, and in the drain region 64, 83 and 85. In the case where n-channel type TFTs and p-channel type TFTs are mixedly provided, since conductivity types of ions used for the n-channel and p-channel transistors are different, ion dopings are performed in two steps. Then a interlayer insulating film 75 is deposited, contact holes which correspond to source/drain regions are made, and then a drain electrode and a source electrode are formed. Through these steps, TFTs in display section and in the driving circuit section are obtained.

In this liquid crystal display panel, another substrate 62 is disposed to oppose to the substrate 61. On the inner surface of the substrate, there is provided an opposing electrode 4. A liquid crystal material 44 is poured into a space between the both substrate 61 and 62.

Figure 6:
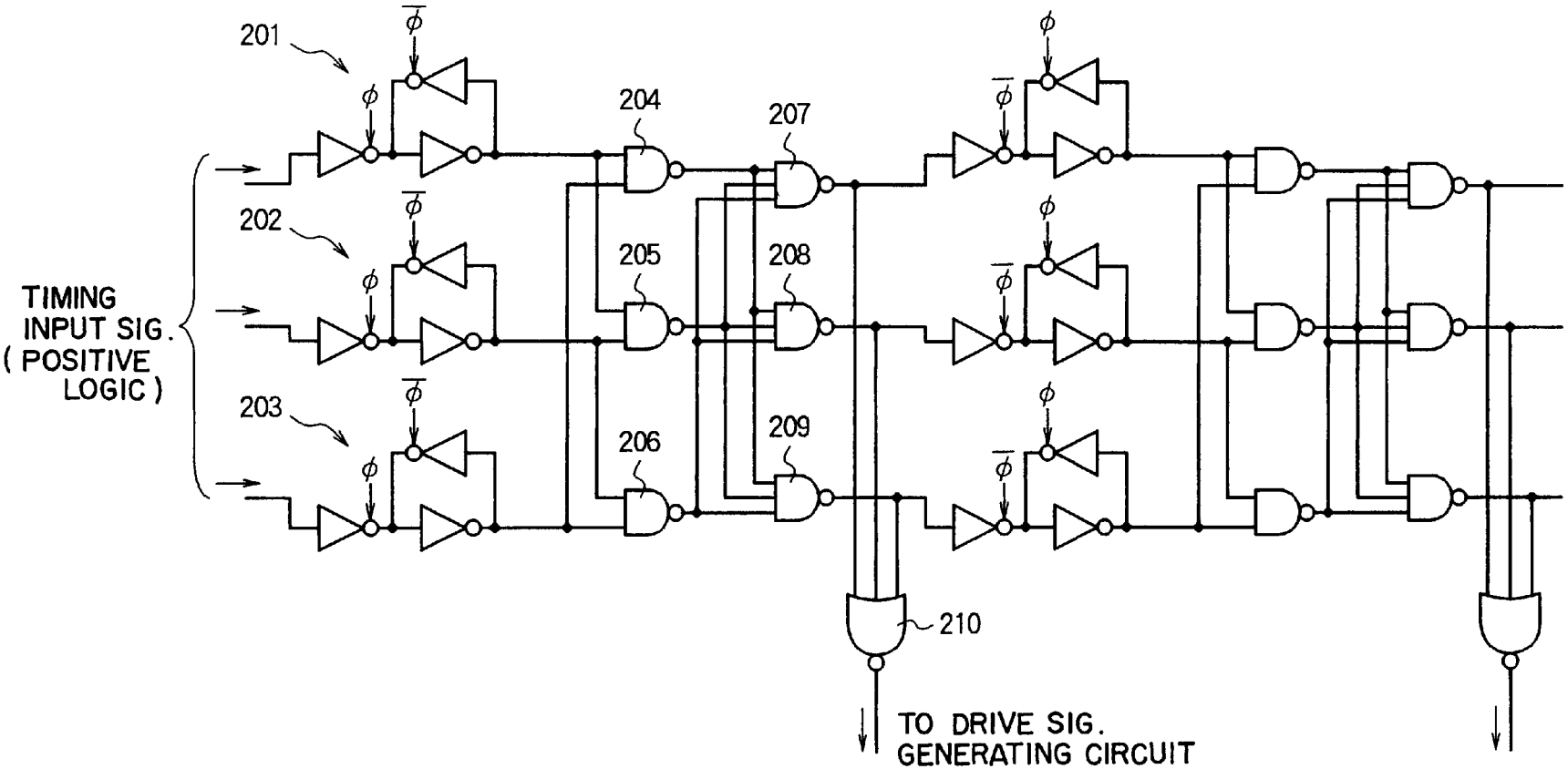
FIG. 6 is a circuit block diagram illustrating the timing signal generating circuit in a second embodiment of the present invention.

FIG. 6 is a circuit block diagram of the timing signal generating circuit in a second embodiment of the present invention.

One unit of the timing signal generating circuit in the second embodiment comprises a shift register train consisting of three pieces of shift registers 201, 202, 203 which simultaneously perform the same operation upon receiving the same clock signals and the same positive logic timing input signals, three pieces of 2-input NAND circuits 204, 205, 206, disposed on the output side of the shift register train, to which mutually different combinations each consisting of two outputs of respective outputs of the three shift registers 201, 202, 203 are each supplied, three pieces of 3-input NAND circuits 207, 208, 209 to which respective outputs of the three 2-input NAND circuits 204, 205, 206 are each outputted, and a single piece of 3-input NOR circuit 210 to which respective outputs of the three 3-input NAND circuits 207, 208, 209 are supplied. The respective outputs of the three 3-input NAND circuits 207, 208, 209 become outputs to the individual shift registers constituting a next-stage shift register train, and an output of the 3-input NOR circuit 210 turns out to be a timing output signal. These constructive units are connected in series at a plurality of stages. In the case of the video display apparatus, this timing output signal is supplied to the drive signal generating circuit, and the matrix lines of the display unit are driven.

By employing the arrangement shown in the second embodiment, as in the first embodiment, the signals can be normally outputted even if the defective signals are generated on the output side of the shift registers. Besides, even when the defective signal occurs on an input-side of any one of the shift registers, the timing input signals of the shift register train can be normally outputted up to the last stage owing to the majority signal pick-up function of the 3-input NOR circuit 210. In consequence, the normal signal pick-up function of the arithmetic circuit can be more enhanced than in the first embodiment.

Figure 7:
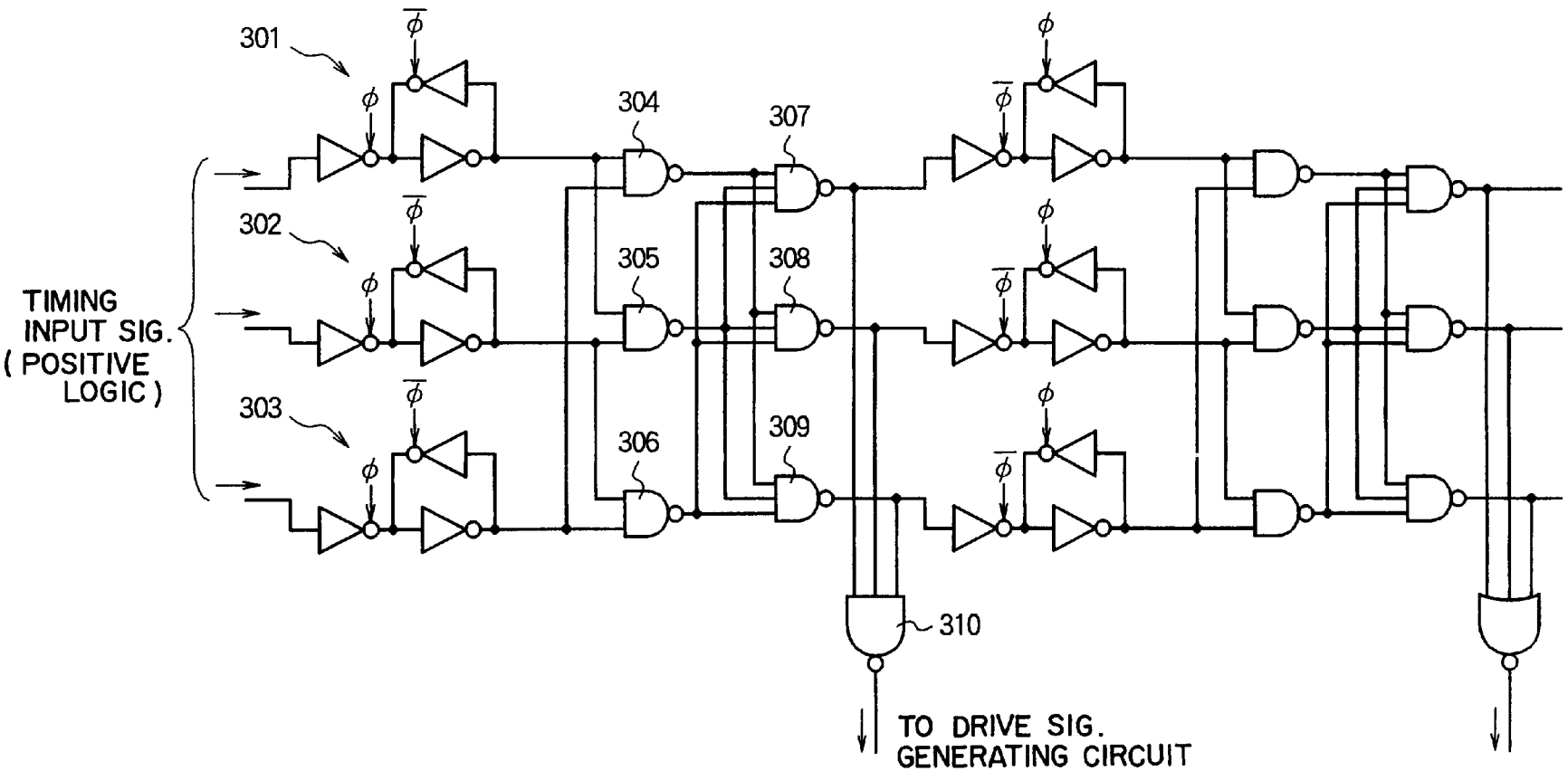
FIG. 7 is a circuit block diagram illustrating the timing signal generating circuit in a third embodiment of the present invention.

FIG. 7 is a circuit block diagram of the timing signal generating circuit in a third embodiment of the present invention.

The timing signal generating circuit in the third embodiment has substantially the same circuit construction as the timing signal generating circuit in the second embodiment, but is different in terms of such a point that a 3-input NAND circuit 310 as a substitute for the 3-input NOR circuit is disposed at the output stage of each constructive unit.

By employing the arrangement in the third embodiment, as in the second embodiment, the signals can be normally outputted even if the defective signals are generated on the output side of the shift registers. Besides, even when the defective signal occurs on the input-side of any one of the shift registers, the timing input signals of the shift register train can be normally outputted up to the last stage owing to the majority signal pick-up function of the 3-input NAND circuit 310. Further, the timing output signals for driving the matrix lines of the video display device, etc. are generated through the 3-input NAND circuit 310, and hence, if the defective signal is produced on the input-side of the shift register, the timing output signals always converge in an off-direction. As a result, the drive signal generating circuit to which the timing output signals are supplied is constructed of an analog switch or the like, and the timing output signal works to open and close a gate of the analog switch. In the case of taking this construction, because of the timing output signals converging in the off-direction, the analog switch converges in a high-impedance state, so that the same effect as being actually cut off by a laser can be obtained. Accordingly, particularly when the drive signal generating circuit is constructed of the analog switch, etc., the normal signal pick-up function of the arithmetic circuit can be much more enhanced than in the second embodiment.

Note that the timing signal generating circuit can be also constructed by combining the second and third embodiments, and picking up and disposing one of the 3-input NOR circuit and the 3-input NAND circuit at every output stage, depending on the timing output signals required, i.e., the construction of the drive signal generating circuit.

Figure 8:
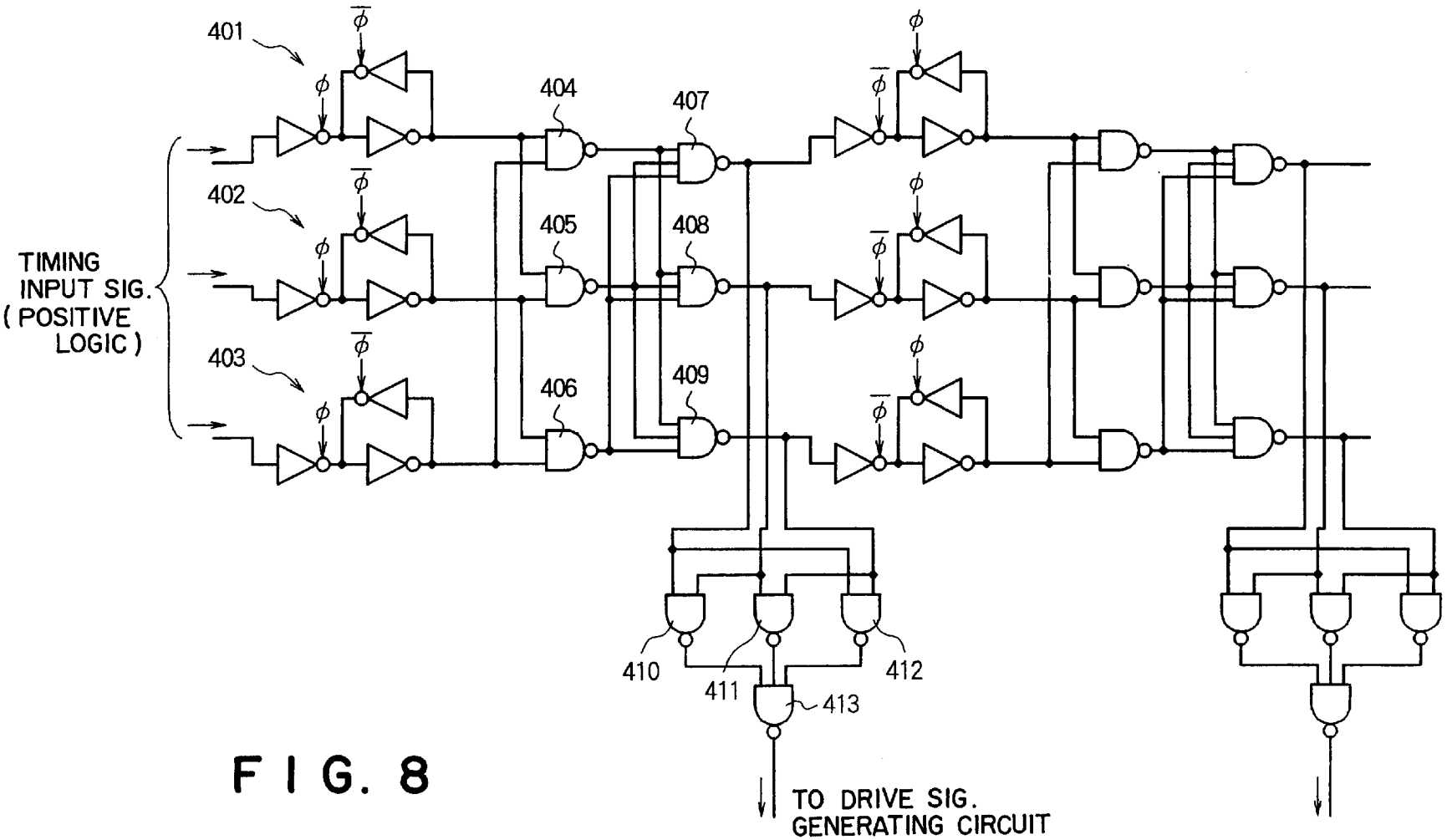
FIG. 8 is a circuit block diagram illustrating the timing signal generating circuit in a fourth embodiment of the present invention.

FIG. 8 is a circuit block diagram of the timing signal generating circuit in a fourth embodiment of the present invention.

The timing signal generating circuit in the fourth embodiment has substantially the same circuit construction as the timing signal generating circuit in the second or third embodiment except for a logic circuit disposed at the output stage of each constructive unit and connected to the drive signal generating circuit.

The logic circuit disposed at the output stage of each constructive unit is constructed of three pieces of 2-input NAND circuits 410, 411, 412 to which mutually different combinations each consisting of two outputs of respective outputs of the three NAND circuits 407, 408, 409 are each supplied, and a single piece of 3-input NAND circuit 413 to which respective outputs of the three 3-input NAND circuits 410, 411, 412 are supplied. The timing output signals are outputted via this logic circuit to the drive signal generating circuit.

Owing to the adoption of the fourth embodiment, even if any one of the three shift registers falls into a malfunction and the input- or output-side of the shift register is supplied with any kind of defective signals, only normal signals can be picked up through the majority operation of the logic circuit consisting of the NAND circuits 404, 405, 406 and the NAND circuits 407, 408, 409, or by the logic circuit consisting of the NAND circuits 410, 411, 412, 413, whereby the timing output signals can be normally generated without performing any repairing operation. Accordingly, the normal signal pick-up capability of the arithmetic circuit can be still more enhanced than in the third embodiment. As a result, the yield and the reliability of the drive circuit can be further enhanced.

Figure 9:
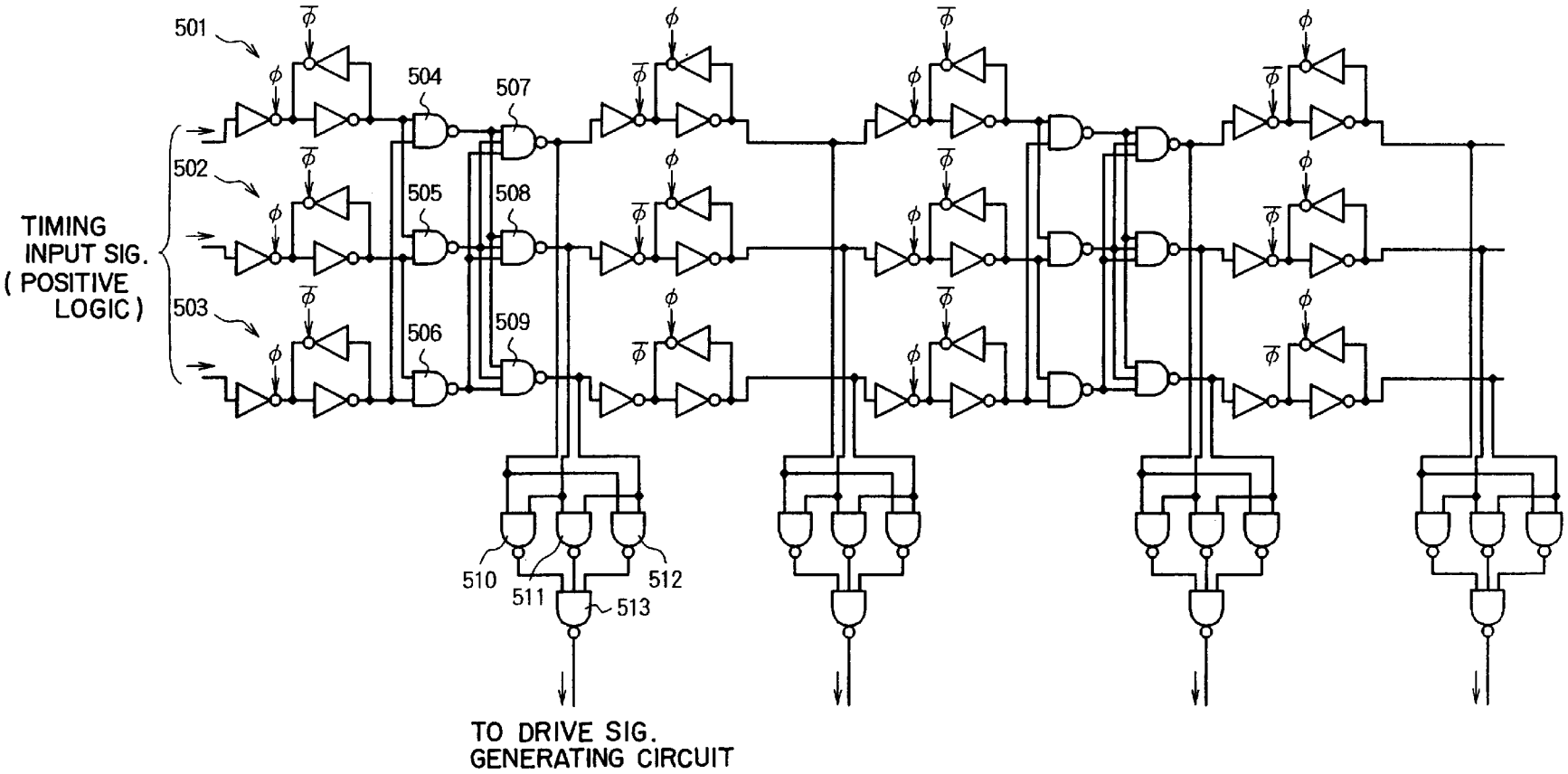
FIG. 9 is a circuit block diagram illustrating a timing signal generating circuit in a fifth embodiment of the present invention.

FIG. 9 is a circuit block diagram of the timing signal generating circuit in a fifth embodiment of the present invention.

The timing signal generating circuit in the fifth embodiment has such a construction that the arithmetic circuit, consisting of the NAND circuits 504, 505, 506 and the NAND circuits 507, 508, 509, for picking up majority signals, is removed at a one-stage interval out of the construction of the timing signal generating circuit in the fourth embodiment and then directly connected.

In view of a standard of the reliability of each element and a probability of occurrence of the defective signal in the present state, the disposition of the arithmetic circuit for majority operation may not be necessarily required for each stage as in the case of the construction of the timing signal generating circuit in the fourth embodiment. In consideration of an efficiency, etc. of integration of the circuit, it might happen that a construction of properly omitting portions where the arithmetic circuits for majority operation are disposed, would be more suited to the utilization.

Owing to the adoption of the fifth embodiment, it is feasible to, as in the fourth embodiment, pick up normal signals except for such a case that the defective signals are produced simultaneously on the output- and input-sides of the shift registers belonging to different shift register trains in the portions where the arithmetic circuits for majority operation are removed, and further to downsize the timing signal generating circuit.

Note that the majority operation arithmetic circuits may be disposed not only at the one-stage interval but also at a two- or more-stage interval, and the disposition thereof may not be necessarily regular.

Figure 10:
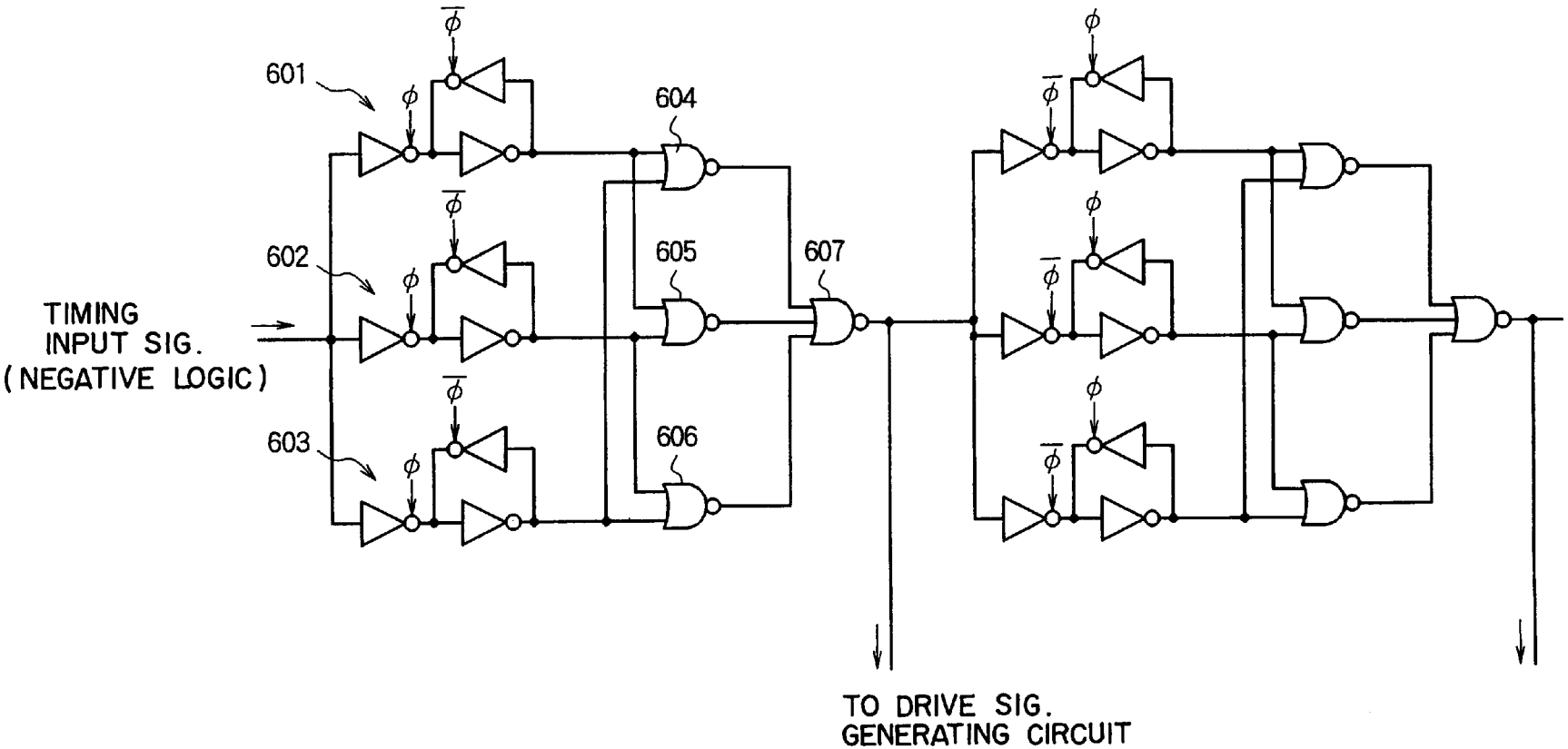
FIG. 10 is a circuit block diagram illustrating the timing signal generating circuit in a sixth embodiment of the present invention.

FIG. 10 is a circuit block diagram of the timing signal generating circuit in a sixth embodiment of the present invention.

The timing signal generating circuit in the sixth embodiment has a construction corresponding to that circuit in the first embodiment when the timing input signal is a negative logic signal. The three 2-input NAND circuits 104, 105, 106 in the timing signal generating circuit in accordance with the first embodiment are respectively replaced with three pieces of 2-input NOR circuits 604, 605, 606, while the single 3-input NAND circuit 697 is replaced with a 3-input NOR circuit.

It is possible to, as in the first embodiment, pick up normal signal even when the operation of the shift register is controlled by the negative logic timing input signal, and to attain the same standards of yield and reliability.

Further, the NAND circuit is similarly replaced with the NOR circuit in the second through fifth embodiments also, thereby making it feasible to attain the same standards of normal signal pick-up function, yield and reliability as those in the respective embodiments discussed above when the timing input signal is the negative logic signal.

Figure 11:
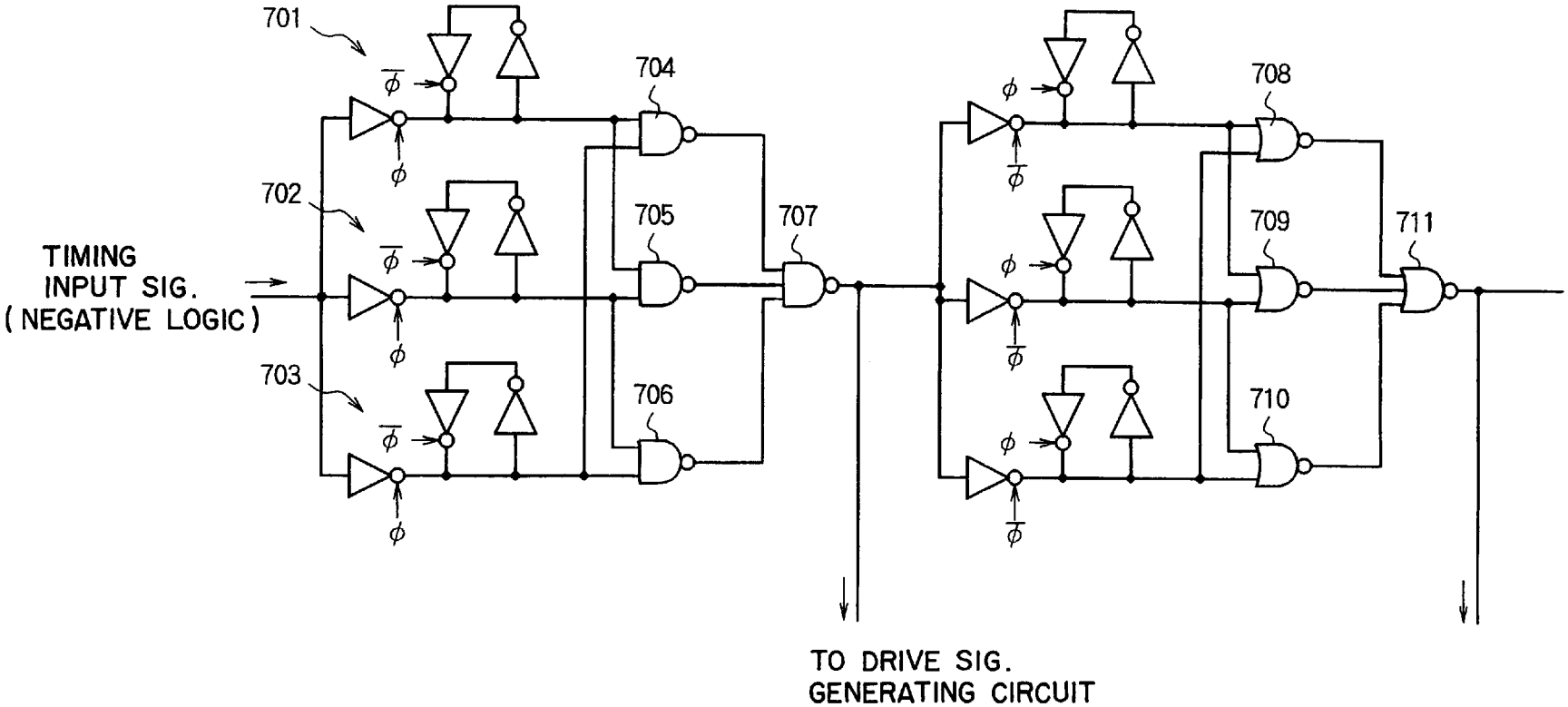
FIG. 11 is a circuit block diagram illustrating the timing signal generating circuit in a seventh embodiment of the present invention.

FIG. 11 is a circuit block diagram of the timing signal generating circuit in a seventh embodiment of the present invention.

The shift register train in the timing signal generating circuit in accordance with the seventh embodiment, is constructed of three pieces of shift registers 701, 702, 703 which simultaneously perform the same operation upon receiving the same clock signals and timing input signals. The arithmetic circuit disposed on the output-side of each shift register comprises three pieces of 2-input NAND circuits 704, 705, 706 to which mutually different combinations each consisting of two outputs of respective outputs of the three shift registers 701, 702, 703 are each supplied, and a single piece of 3-input NAND circuit 707 to which respective outputs of the three 2-input NAND circuits 704, 705, 706 are supplied, at the stage where the positive logic timing input signals are supplied. The arithmetic circuit is, at the stage where the negative logic timing input signals are supplied, constructed of three pieces of 2-input NOR circuits 708, 709, 710 to which mutually different combinations each consisting of two outputs of respective outputs of the three shift registers are each supplied, and a single piece of 3-input NOR circuit 711 to which respective outputs of the three 2-input NOR circuits 708, 709, 710 are supplied.

Owing to the adoption of the seventh embodiment, even if the output logic of the shift register in the timing signal generating circuit is inverted stage by stage, as in the first embodiment, it is possible to pick up normal signals through the majority operation and attain the same standards of yield and reliability.

Figure 12:
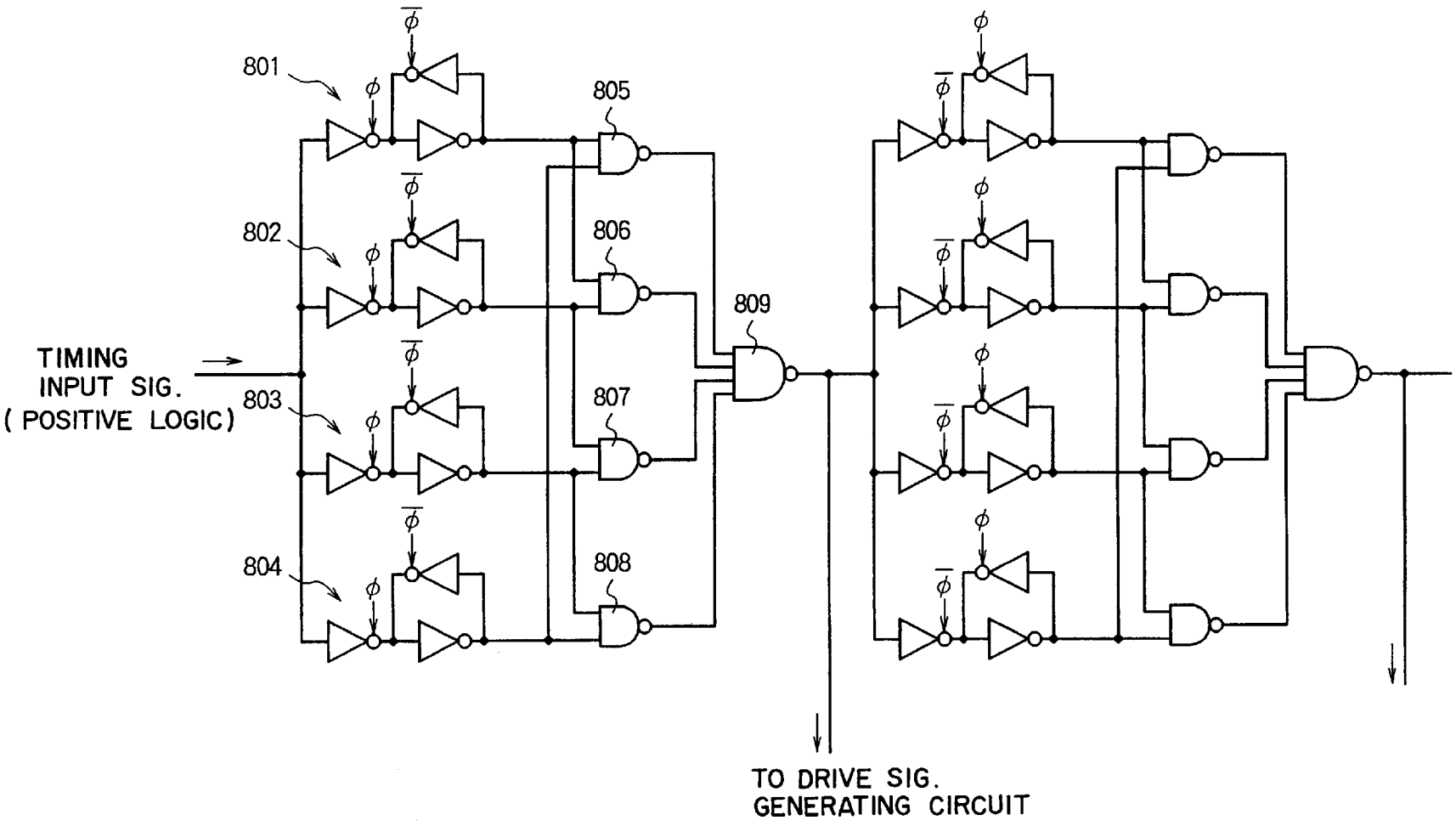
FIG. 12 is a circuit block diagram illustrating the timing signal generating circuit in an eighth embodiment of the present invention.

FIG. 12 is a circuit block diagram illustrating the timing signal generating circuit in an eighth embodiment.

The timing signal generating circuit in the eighth embodiment is constructed of four shift register trains substituting the three shift register trains in the first embodiment. One unit of the timing signal generating circuit comprises a shift register train consisting of four pieces of shift registers 801, 802, 803, 804 which simultaneously perform the same operation upon receiving the same clock signals and the same positive logic timing input signals, four pieces of 2-input NAND circuits 805, 806, 807, 808, disposed on an output side of the shift register train, to which mutually different combinations each consisting of two outputs of respective outputs of the four shift registers 801, 802, 803, 804 are each supplied, and a single piece of 4-input NAND circuit 809 to which respective outputs of the four 2-input NAND circuits 805, 806, 807, 808 are supplied.

Owing to the adoption of the eighth embodiment, the yield and the reliability of the drive circuit can be more enhanced than by the timing signal generating circuit in the first embodiment.

The timing signal generating circuit according to the present invention is capable of obtaining the same effects regardless of the type and the number of shift registers and the positive or negative of the drive logic signal on condition that the arithmetic circuit for majority operation is disposed at the output-side of the shift register train consisting of three or more shift registers in addition to the respective embodiments discussed above. Further, the timing output signal to the drive signal generating circuit may be fetched directly from the outputs of the shift registers.

Figure 13:
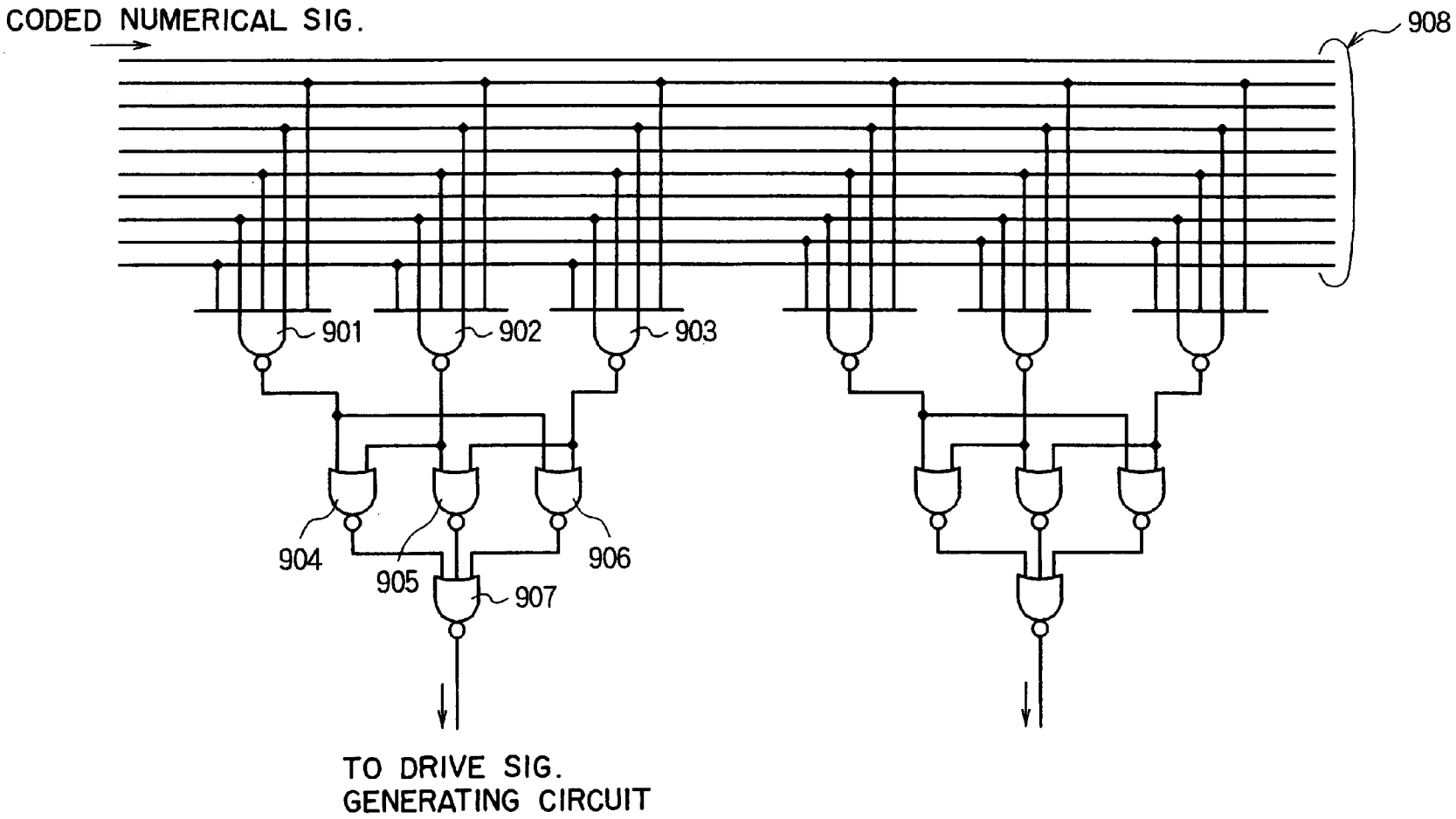
FIG. 13 is a circuit block diagram illustrating the timing signal generating circuit in a ninth embodiment of the present invention.

FIG. 13 is a circuit block diagram of the timing signal generating circuit in a ninth embodiment of the present invention.

The timing signal generating circuit in the ninth embodiment takes a decoder type construction for selectively outputting the signal, corresponding to a numerical signal supplied. Each constructive unit comprises a single decoder circuit group consisting of three pieces of decider circuits 901, 902, 903 for selectively outputting negative logic signals at the same timing in accordance with the numerical signals supplied, three pieces of 2-input NOR circuits 904, 905, 906 to which mutually different combinations each consisting of two outputs of respective outputs of the three decoder circuits of each decoder circuit group are each supplied, and a single piece of 3-input NOR circuit 907 to which respective outputs of the three 2-input NOR circuits 904, 905, 906 are supplied. The signals supplied to the drive signal generating circuit are output signal of the 3-input NOR circuit 907.

Owing to the adoption of the ninth embodiment, the defective signal attributed to a drive defect of the decoder circuit is eliminated by the majority operation arithmetic circuit consisting of the three 2-input NOR circuits 904, 905, 906, and the single 3-input NOR circuit 907, and the defective signals of some decoder circuits can be continuously used without effecting the repairing operation of these defective signals. As a result, the yield and the reliability can be more enhanced than by the conventional decoder type timing signal generating circuit.

Note that the same effects can be obtained by substituting the NAND circuits for the NOR circuits if the decoder circuits output the positive logic signals. In others, it is feasible to change the type and the number of the decoder circuits, and a content of the numerical signal with respect to the decoder circuit group on condition that the arithmetic circuit for picking up normal signal is disposed on the output-side of the decoder circuit group consisting of three or more decoders for outputting the signals at the same timing.

Figure 14:
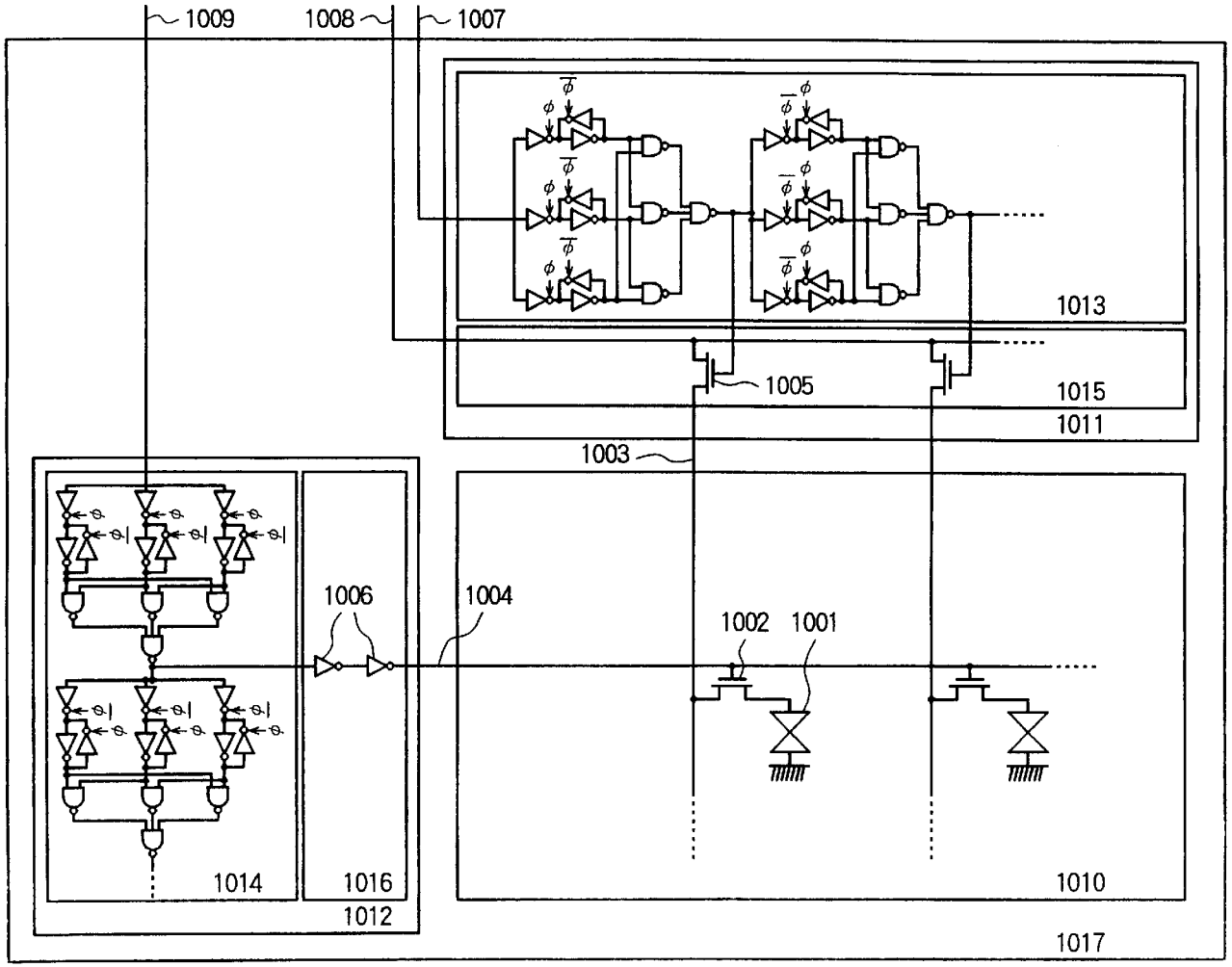
FIG. 14 is a circuit block diagram when the timing signal generating circuit in the first embodiment of the present invention is applied to a drive circuit integral type liquid crystal display device.

FIG. 14 is a circuit block diagram when the timing signal generating circuit in the first embodiment of the present invention that is illustrated in FIG. 1 is applied to a drive circuit integral type liquid crystal display device.

An X-line 1003 is controlled by a timing output signal fetched out of a timing generation circuit 1013 in the first embodiment through a MOS transistor 1005. Then, a Y-line 1004 is controlled by a timing output signal fetched out of a timing generation circuit 1014 in the first embodiment through two pieces of inverters 1006, and further a liquid crystal display element 1001 is controlled by the X- and Y-lines 1003, 1004 through a MOS transistor 1002.

The yield and the reliability can be remarkably enhanced by applying the timing signal generating circuit according to the present invention to the liquid crystal display device.

Figure 15:
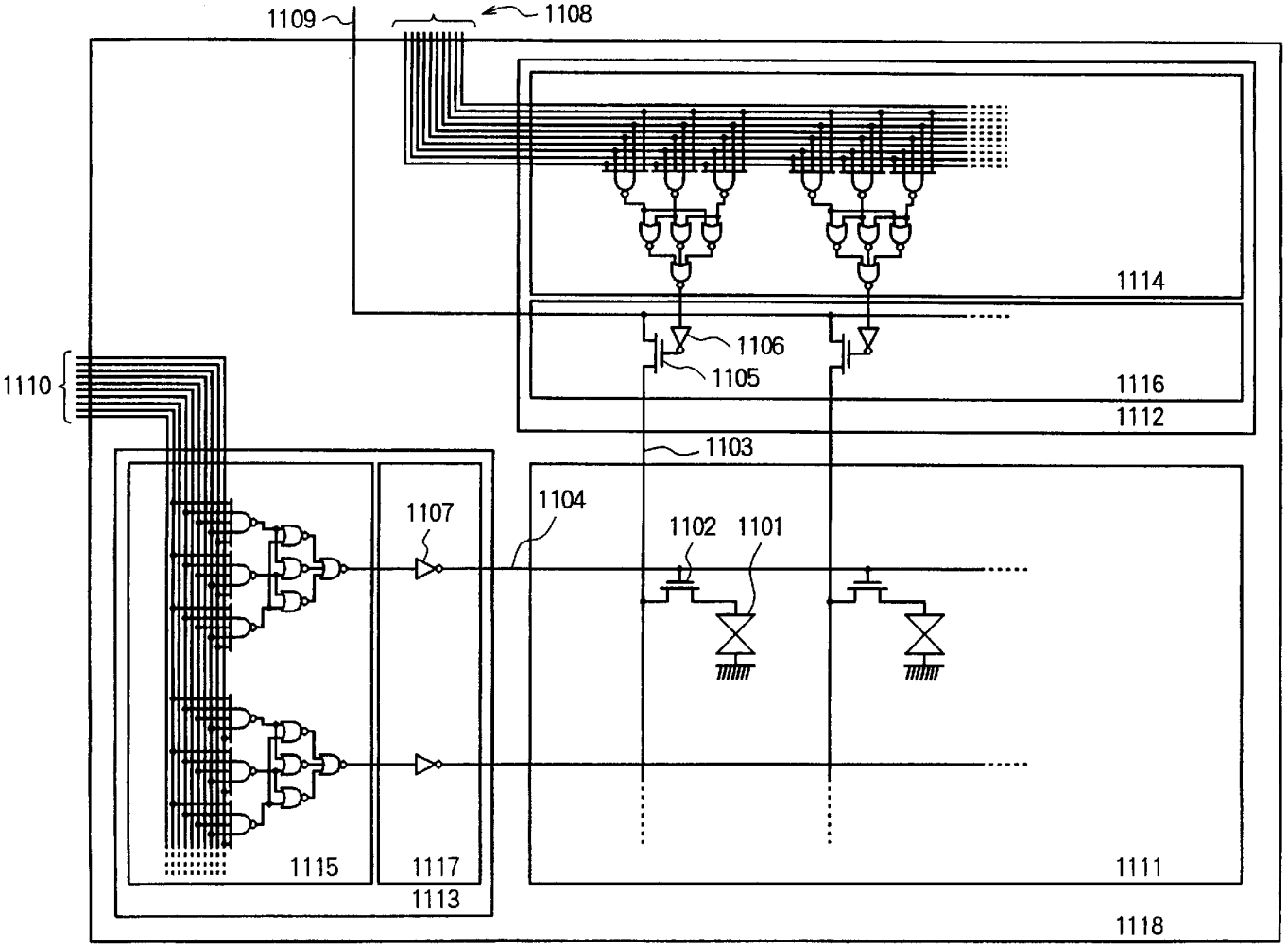
FIG. 15 is a circuit block diagram when the timing signal generating circuit in the ninth embodiment of the present invention is applied to the drive circuit integral type liquid crystal display device.
Figure 16:
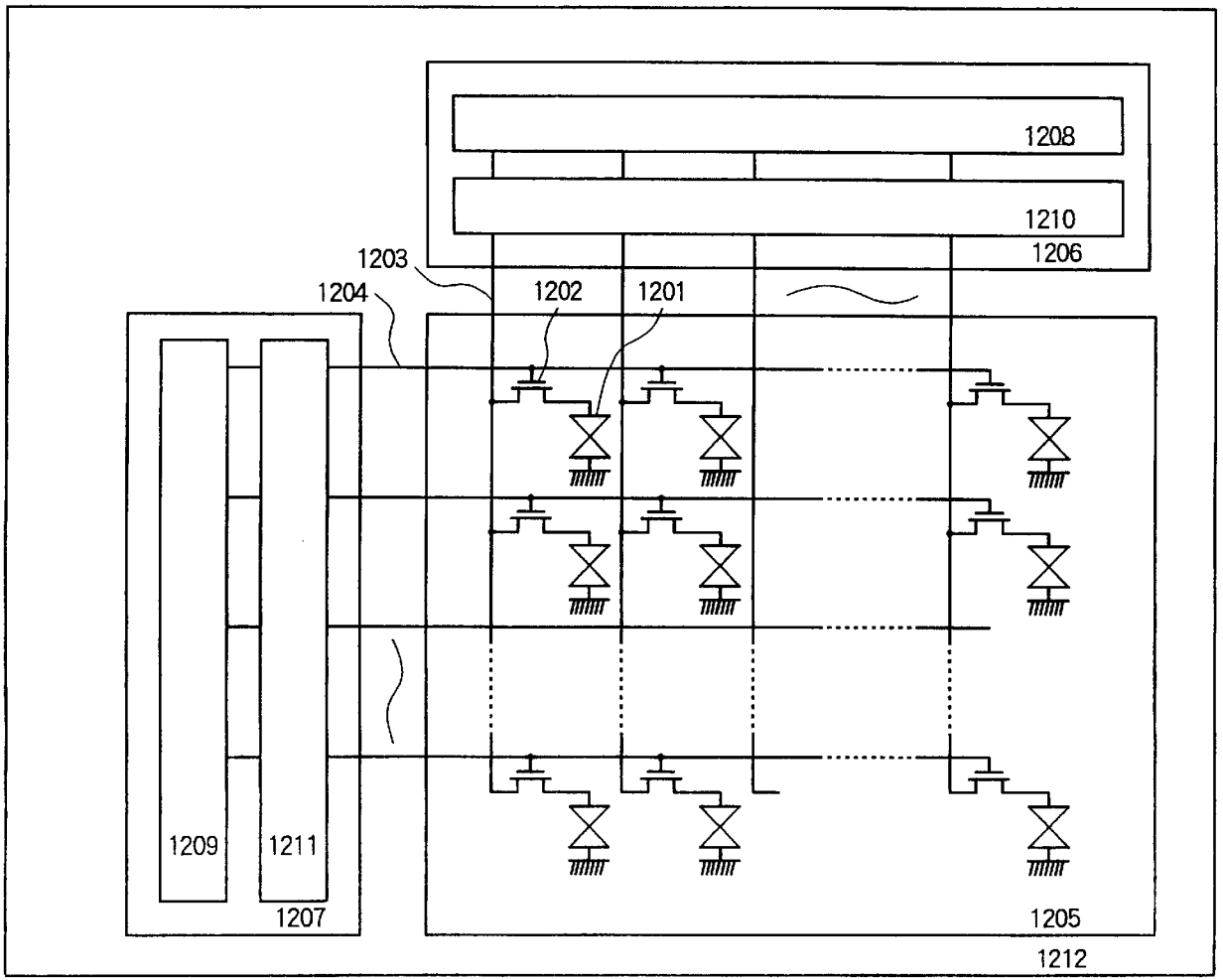
FIG. 16 PRIOR ART
FIG. 16 is a schematic block diagram illustrating an active matrix type liquid crystal display device.
Figure 17:
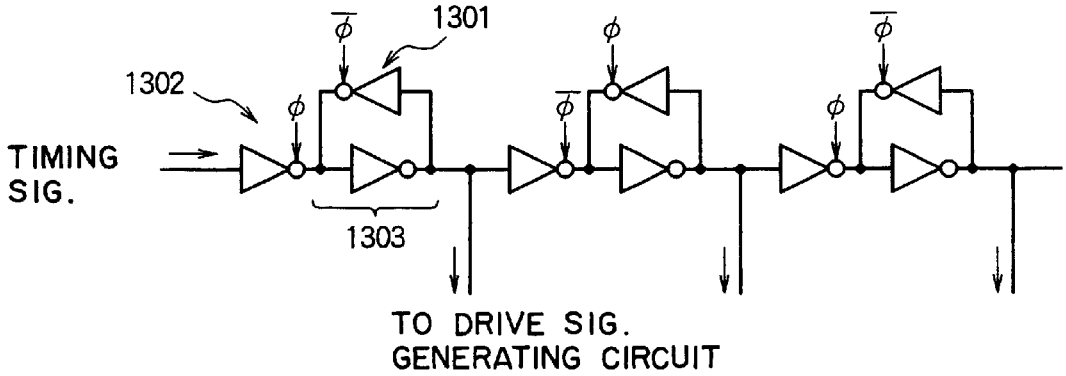
FIG. 17 PRIOR ART
FIG. 17 is a circuit block diagram showing one example of a shift register type timing signal generating circuit.
Figure 18:
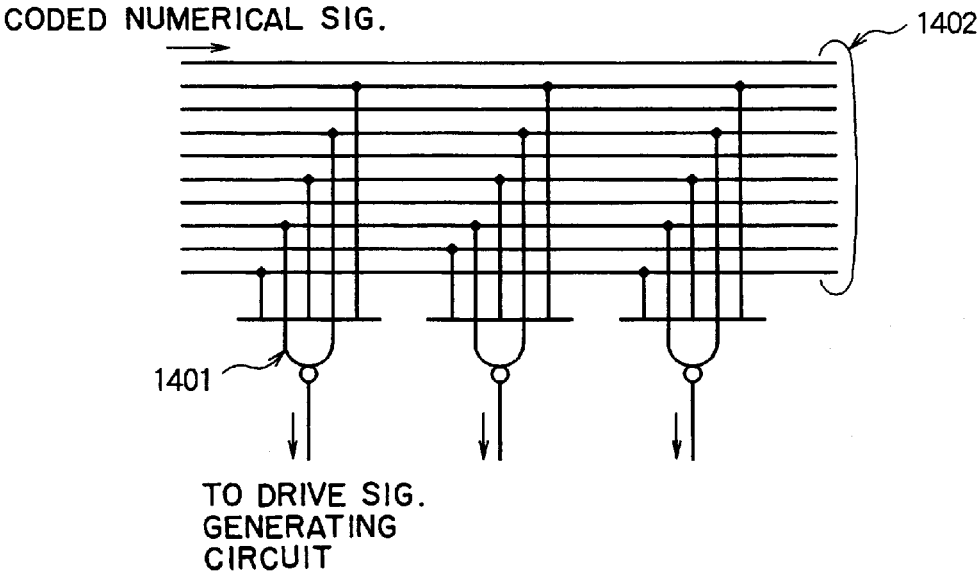
FIG. 18 PRIOR ART
FIG. 18 is a circuit block diagram showing one example of a decoder type timing signal generating circuit.
Figure 19:
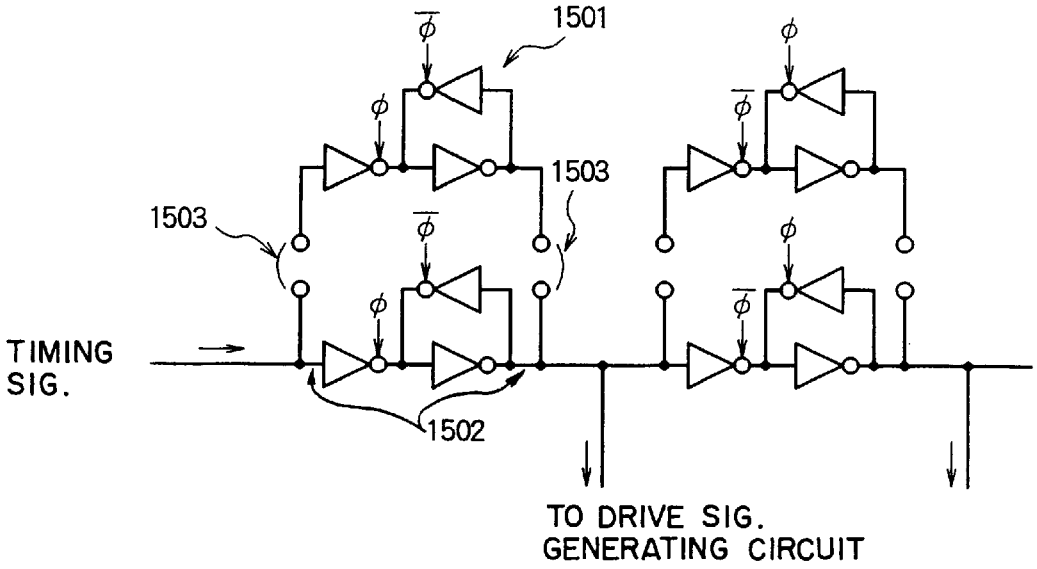
FIG. 19 PRIOR ART
FIG. 19 is a circuit block diagram illustrating the timing signal generating circuit previously incorporating a preparatory shift register.
Figure 20:
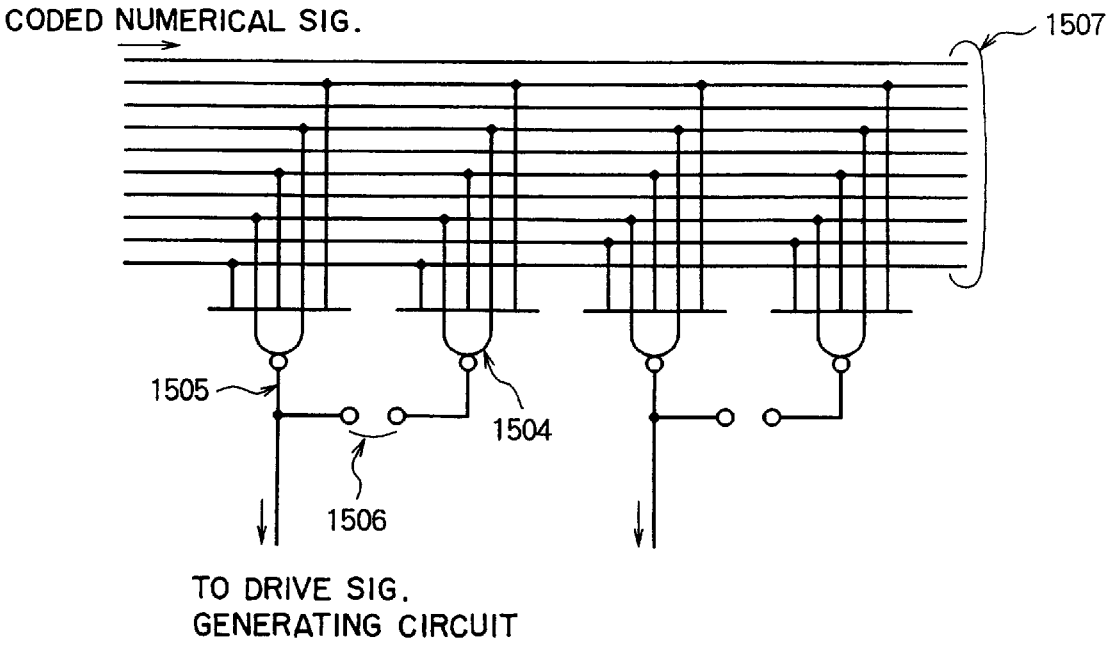
FIG. 20 PRIOR ART
FIG. 20 is a circuit block diagram illustrating the timing signal generating circuit previously incorporating a preparatory decoder.
Figure 21:
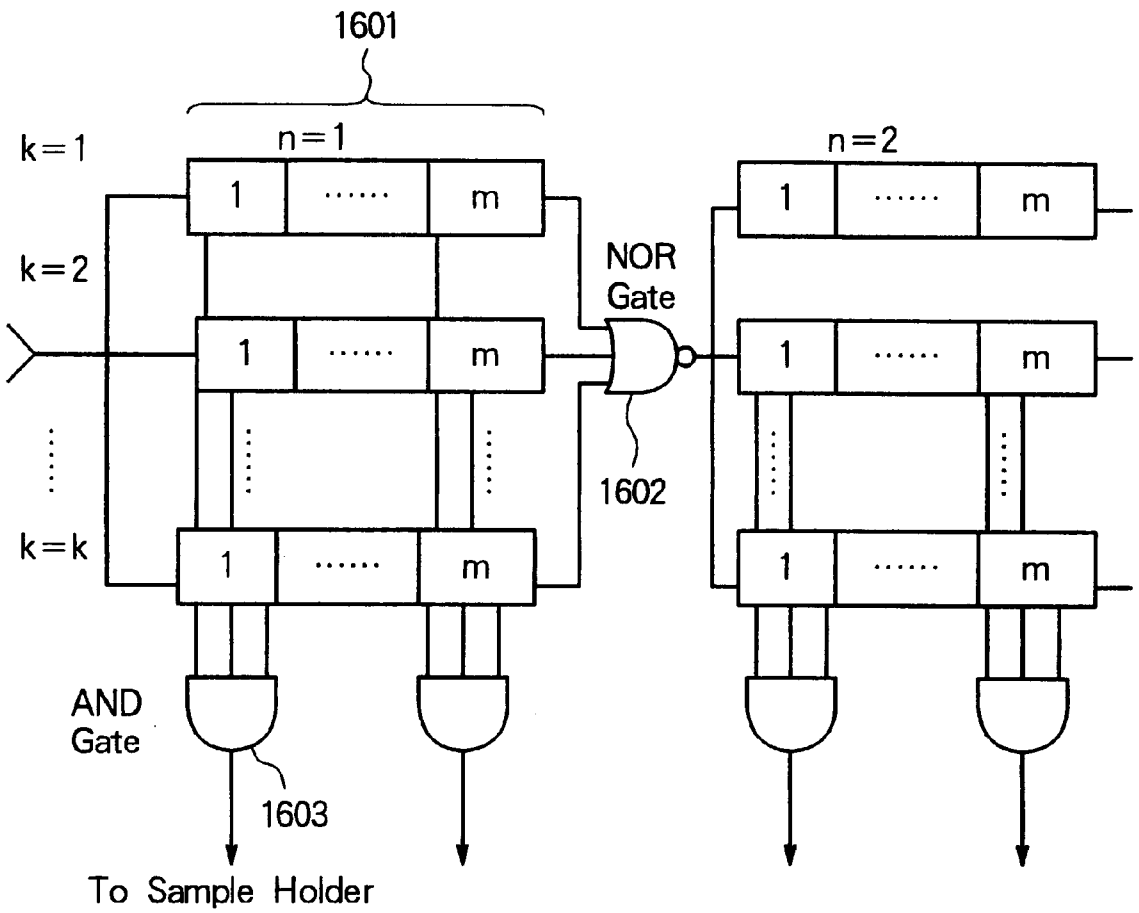
FIG. 21 PRIOR ART
FIG. 21 is a circuit block diagram illustrating the timing signal generating circuit constructed such that k-trains of shift registers operating at the same timing are arranged in parallel, and k-input NOR circuits are inserted at an interval of a plurality of shift registers.

FIG. 15 is a circuit block diagram when the decoder type timing signal generating circuit in the ninth embodiment of the present invention, is applied to the drive circuit integral type liquid crystal display device.

An X-line 1103 is controlled by a timing output signal fetched out of a timing generation circuit 1114 in the ninth embodiment through an inverter 1106 and a MOS transistor 1105. Then, a Y-line 1104 is controlled by a timing output signal fetched out of a timing generation circuit 1115 in the ninth embodiment through an inverter 1107, and further a liquid crystal display element 1101 is controlled by the X- and Y-lines 1103, 1104 through a MOS transistor 1102.

In this case also, the yield and the reliability can be remarkably enhanced by applying the timing signal generating circuit according to the present invention to the liquid crystal display device.

The respective embodiments of the present invention have been discussed so far, however, if the same basic construction is provided, the same effects can be obtained in other modified embodiments. That is, the timing signal generating circuit may be constructed basically of the shift registers or the decoders on condition that the circuit is constructed including the arithmetic circuit for picking up normal signals, which arithmetic circuit is disposed on the output-side of the three or more circuits for outputting the same timing and adapted to the positive and negative of logic of the signals for operating these circuits. The number of circuit constructive units for the single normal signal pick-up arithmetic circuit can be adequately set depending on the cases. Moreover, any types of video display apparatuses to which the timing signal generating circuit according to the present invention are, as far as they are classified as a matrix driving system picture device, capable of obtaining the same effects.

What is claimed is:

1. A display apparatus comprising:

a timing signal generating circuit including:

a plurality of timing signal generating units, each including three or more shift registers and generating binary timing signals as outputs, said shift registers being connected to each other in parallel, said timing signal generating units being connected to each other in series; and a plurality of connecting units, each unit (i) disposed between adjacent timing signal generating units and in series thereto, and (ii) for producing a predetermined timing signal based upon the output signals received from said shift registers of one of said adjacent timing signal generating units at a stage anterior to said connecting unit and (iii) outputting the predetermined timing signal to the other of said adjacent timing signal generating units at a stage posterior to said connecting unit;

wherein each connecting unit includes an arithmetic means for processing the output signals of said anterior-stage timing signal generating unit, processing including (i) detecting the output signals and (ii) sensing a majority signal from among the output signals, thus producing the predetermined timing signal thereby, said connecting unit providing the predetermined timing signal to said posterior-stage timing signal generating unit and output terminals in parallel therewith;

a sampling unit for sampling a predetermined drive signal based on the predetermined timing signal provided to the output terminals and outputting the drive signal to a drive line; and a plurality of unit pixels connected to the drive line;

wherein said plurality of unit pixels are connected to a transistor driven by said drive line, and said shift registers and arithmetic means are constructed of transistors, and wherein said transistor connected to said unit pixels and said transistors constituting said shift registers and said arithmetic means, are manufactured in the same process.

2. A display apparatus comprising:

a timing signal generating circuit including:

a plurality of timing signal generating units, each including three or more decoders and generating binary timing signals as outputs, said decoders being connected to each other in parallel, said timing signal generating units being connected to each other in series; and a plurality of connecting units, each unit (i) disposed between adjacent timing signal generating units and in series thereto, and (ii) for producing a predetermined timing signal based upon the output signals received from said decoders of one of said adjacent timing signal generating units at a stage anterior to said connecting unit and (iii) outputting the predetermined timing signal to the other of said adjacent timing signal generating units at a stage posterior to said connecting unit;

wherein each connecting unit includes an arithmetic means for processing the output signals of said anterior-stage timing signal generating unit, processing including (i) detecting the output signals and (ii) sensing a majority signal from among the output signals, thus producing the predetermined timing signal thereby, said connecting unit providing the predetermined timing signal to said posterior-stage timing signal generating unit and output terminals in parallel therewith;

a sampling unit for sampling a predetermined drive signal based on the predetermined timing signal provided to the output terminals and outputting the drive signal to a drive line; and a plurality of unit pixels connected to the drive line;

wherein said plurality of unit pixels are connected to a transistor driven by said drive line, and said decoders and arithmetic means are constructed of transistors, and wherein said transistor connected to said unit pixels and said transistors constituting said decoders and said arithmetic means, are manufactured in the same process.

* * * * *